United States Patent [19]

Reba

[11] Patent Number: 4,472,886

[45] Date of Patent: Sep. 25, 1984

[54] SYSTEM AND METHOD FOR VENTING COOLING AIR FROM FILAMENTS

[75] Inventor: Imants Reba, Vancouver, Wash.

[73] Assignee: Crown Zellerbach Corporation, Camas, Wash.

[21] Appl. No.: 342,526

[22] Filed: Jan. 25, 1982

[51] Int. Cl.[3] ..... F26B 3/10; F26B 17/10

[52] U.S. Cl. ..... 34/10; 34/34; 34/156; 28/283; 226/7; 226/97

[58] Field of Search ..... 34/155, 156, 23, 34, 34/10; 226/7, 97; 19/299, 304; 28/282, 283, 289

[56] References Cited

U.S. PATENT DOCUMENTS

| | | | |
|---|---|---|---|
| 2,052,869 | 9/1936 | Coanda | 299/107 |
| 2,982,994 | 5/1961 | Fernstrom | 18/8 |
| 3,692,618 | 9/1982 | Dorschner | 161/72 |
| 3,776,796 | 12/1973 | Lipsgomb et al. | 19/299 |
| 3,946,546 | 3/1976 | Venot | 57/34 HS |
| 4,014,487 | 3/1977 | Reba et al. | 226/5 |
| 4,057,910 | 11/1977 | Sachleben | 34/227 |
| 4,285,452 | 8/1981 | Reba et al. | 28/289 |

*Primary Examiner*—Larry I. Schartz
*Attorney, Agent, or Firm*—Jerome S. Marger

[57] ABSTRACT

A system and method for venting cooling air from a plurality of filaments with which said air has been associated, employing a Coanda flow attachment means, including a Coanda flow attachment surface, to separate the filaments and air into respective streams, and then to divert said air stream in a direction away from said filament stream.

14 Claims, 4 Drawing Figures

SYSTEM AND METHOD FOR VENTING COOLING AIR FROM FILAMENTS

BACKGROUND OF THE INVENTION

This invention relates to a system and method for venting air from a plurality of filaments with which the air has become associated. The air is used to cool the filaments in a filament quench chamber.

In the production of nonwoven fabrics, conventional melt-spinning techniques are employed at elevated temperatures to produce a plurality of melt-spun filaments, which are drawn by high velocity vent air systems. The hot filaments exit the spinneret and are openly drawn in a downward direction by the jet system. The filaments are simultaneously cooled and drawn in order to achieve the desired filament denier and strength properties. Therefore, nonwoven sheets produced from these filaments will have certain specified physical strength properties.

The cooling step conducted in the quench chamber employs a very stable, essentially laminar, air flow, which is typically introduced either parallel or perpendicular to the filament flow. A substantial air flow disturbance will result in problems such as weaving, sticking, entanglement, and breaking of the filaments. This is a particular problem in systems where large numbers of filaments are drawn by a single jet system.

As the filaments descend downwardly from the spinneret to the quench chamber exit, they are elongated by the draw forces imparted by the jet system and the speed of the filaments dramatically increase. The filament velocity within the quench chamber varies substantially from the upper end, where the hot filaments slowly exit from the spinneret, i.e., typically at less than about one foot per second (about 0.3 meter per second), to the lower end, where the filaments are traveling at generally about 200 feet per second (about 60 meters per second). Therefore, a filament velocity gradient is created within the quench chamber.

Each downwardly descending filament is surrounded by a boundary layer of air. This associated boundary air layer moves at essentially the same velocity as the filaments. Therefore, an air velocity gradient is also created.

Cooling air generally enters the quench chamber in a transverse direction, at the rate of about 1.5 to 7.0 feet per second (about 0.5 to 2.0 meters per second). Since the filaments are traveling at a relatively slow velocity as they exit the spinneret, the cooling air passes transversely through the filaments and can therefore exit from the upper end of the quench chamber. However, as the velocity of the filaments and associated boundary air increases to a rate in excess of the velocity of the cooling air, the cooling air becomes associated therewith, is carried to the lower end of the chamber, and exits therefrom with the filaments and the boundary layer air. Therefore, a "pumping effect" is imparted to the air in the quench chamber by the descending filaments. Any air surrounding the chamber which enters the quench chamber is also entrained and carried along with the downwardly descending filaments.

The conventional quench chamber and the air draw system, respectively, is open between the quench chamber exit and the jet draw system (see FIG. 1). The use of such devices results in impingement of the total pumped air stream described above on the jet draw system, causing turbulence, and disrupting the filament flow pattern.

Various types of systems are provided in the prior art, in which melt-spun filaments are quenched. In U.S. Pat. No. 2,982,994 to Fernstrom, for example, air from chamber 28 is introduced at the closed chamber 14. The air flow is introduced substantially concurrently with respect to the filament flow. The spent air is removed from passage 36 located at the top of chamber 14. In closing the intermediate area forming chamber 14, access to the filaments is unduly limited. Operations such as start-up and threading are particularly affected by this limited accessability.

U.S. Pat. No. 4,057,910 to Sachleben et al. describes a diffuser 1, in the form of a slatted cage, located within a closed quench stack 2, providing a means for facilitating exhausting of quenched air from quench chamber 2, in direction 9, while spun yarn 11 exits in direction 10. A closed, blast head device is also set forth in U.S. Pat. No. 3,946,546 to Venot for aspirating a textile thread with air.

Air transport systems have also been employed stabilizing the leading edge of a fibrous web (see U.S. Pat. No. 4,014,487 to Reba), for purposes of separating per se the air stream from the web, employing Coanda surface 44 and bar members 30. In this case, the web is not quenched with air.

In certain prior art systems, an enclosed intermediate area, such as described in the Fernstrom patent, will be satisfactory. For example, it would be quite acceptable for use in conventional textile spinning operations which employ take-up spools and winders.

However, they would be quite impractical for systems such as described in U.S. Pat. No. 3,692,618 to Dorschner; and U.S Ser. No. 192,973, filed Oct. 2,1980, now Pat. No. 4,322,027, to Reba, which employ high velocity air jet systems to draw the filaments as they exit from a spinneret. The use of these high velocity systems facilitates high filament draw-off speed, and relatively large numbers of closely spaced filaments are transported through the system on a continuous basis. At start-up of a system employing this filament draw apparatus, the entire spinneret output is typically advanced from a spinneret plate into a starter jet system located behind the primary filament draw system (see FIG. 1, starter jet system 80). This means that a path must be kept open from the spinneret plate to the starter jet system. Furthermore, a draw system of the type described above requires continuous monitoring of the filament count during operation to maintain a constant filament level with respect to the draw nozzle. If an access store door is provided in an enclosed system, such as the hinged door 22 of U.S. Pat. No. 2,982,994, and the door is left in an open position, turbulent air flow will be produced in the quench air chamber 14, causing a disruption of the filaments, as previously described.

SUMMARY OF THE INVENTION

The subject invention is directed to a system and to a method employing a Coanda flow attachment means, including a Coanda flow attachment surface, for venting air from a plurality of filaments with which the air has become associated. The Coanda effect, which has been known for many years, is exemplified in U.S. Pat. No. 2,052,869 to Coanda. The system of the subject invention does not enclose the area between the quench chamber and the air jet system, as provided in U.S. Pat.

No. 2,982,994. Direct transfer of a plurality of closely associated filaments from the spinneret plate to the start-up jet system, and visual monitoring of the filament count, respectively, are effectively and efficiently facilitated while, at the same time, air turbulence below the quench chamber is minimized. Thus, subsequent drawing of the filaments by the air jet system is not adversely affected. More specifically, the filaments and a substantial amount of the cooling air associated therewith are separated into respective filament air flow streams, and the air stream is diverted from the filament stream, in a controled manner, by attachment to, and continuous traversal of, a Coanda flow attachment surface. The filament stream is then discharged in a substantially vertical direction while the air stream is impelled in a direction away from said filament stream. By employing the system and method of this invention, the Coanda flow attachment surface provides an uninterrupted, continuous flow pathway for diverting a substantial amount of the associated air.

The Coanda flow attachment means, and accordingly the Coanda flow attachment surface, is preferably pivotally attached to the bottom of the quench chamber. The surface preferably is adjustable to a plurality of positions, with respect to the vertically descending filaments, from the point at which the filaments contact the Coanda flow attachment surface, to the point, in a direction away from said filament stream, that attachment of the air stream to the Coanda surface ceases. This permits establishment of the optimum position of said Coanda attachment surface with respect to said filaments for air stream venting and/or filament stream stabilization.

The separated filament streams are then conveyed, for example, to a jet draw system. Impingement by any nonseparated air which remains associated with the filaments, against the draw system, is minimized so that excessive air turbulence, as previously described, is avoided. This, in turn, facilitates the production of nonwoven webs having excellent product quality.

DETAILED DESCRIPTION OF THE DRAWINGS

Figure 1:
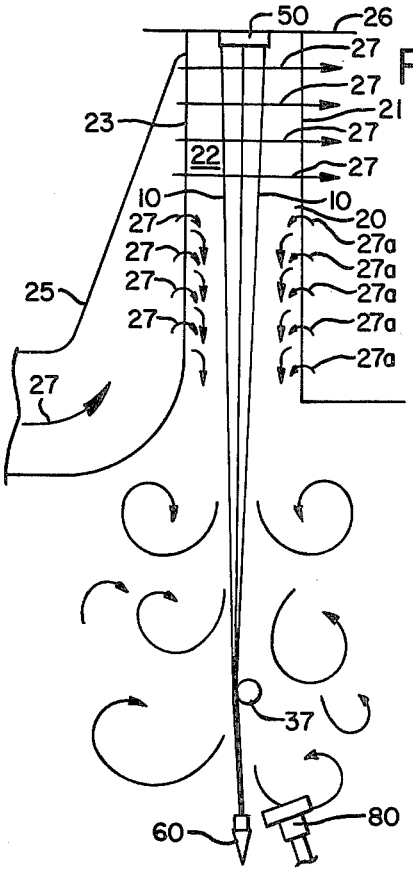

FIG. 1 is an illustrative representation of a prior art filament formation system 1 comprising filament-spinning means 50, a quench chamber 20, stabilizing means 37, and high velocity air jet draw system 60.

Figure 2:
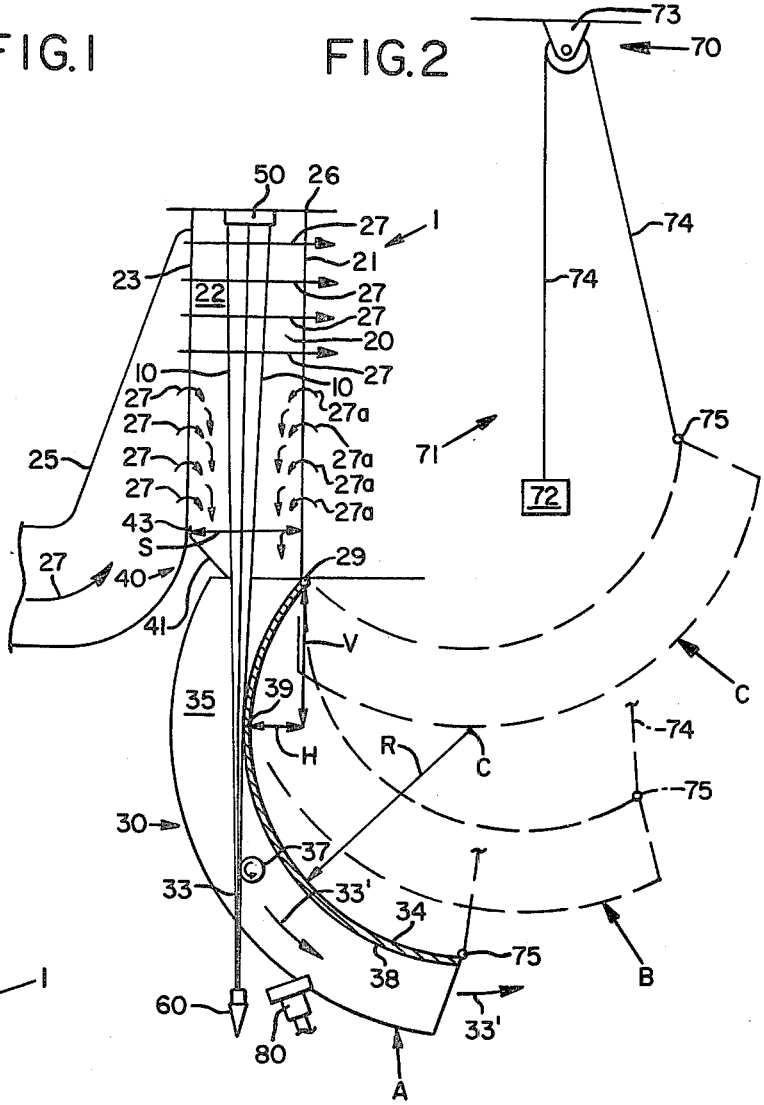

FIG. 2 is the illustrative representation of the system of FIG. 1, which further depicts the system of this invention, including a partially fragmentary end view of Coanda flow attachment means 30 (in positions A–C), adjustable position controling means 70, and air gap adjustment means 40.

Figure 3:
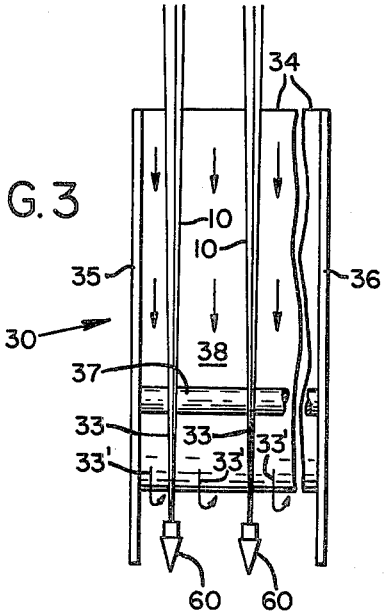

FIG. 3 is a partially fragmentary frontal view of attachment means 30.

Figure 4:
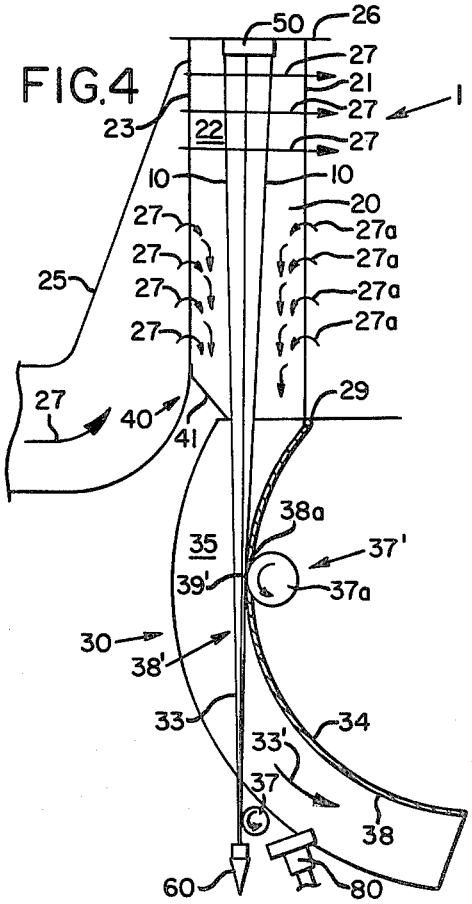

FIG. 4 depicts the system of FIG. 2 and further includes a novel Coanda flow attachment surface 38' comprising stabilizing means 37' and attachment surface 38.

DETAILED DESCRIPTION OF THE INVENTION

Referring now to FIGS. 2–4, a vent air system 1, constructed in accordance with the present invention, is provided. Polymeric filaments 10 for use in nonwoven fabrics can be produced using various known devices. For example, synthetic polymers such as polyolefins can be spun into filaments employing spinneret 50 or other like conventional spinning apparatus. A plurality of filaments 10 are produced, exit from spinneret 50, and are transported in a downward direction.

Located below spinneret 50, and between spinneret 50 and the high velocity jet system 60, is a quench chamber 20. Filaments 10 are preferably drawn by the high velocity jet system 60. The quench chamber 20 comprises sidewalls 21–24, and top wall 26. Cooling air 27 is supplied to the chamber from a remote source such as a fan. The air is filtered and turbulence minimized prior to supplying same to the quench chamber.

The cooling air 27 is fed into chamber 20, preferably in a substantially transverse direction and passes countercurrently among, and becomes associated with, the downwardly descending filaments. Cooling air 27 is employed to lower the temperature of filaments 10 in order to produce filaments of desired properties.

A Coanda flow attachment means 30, including Coanda flow attachment surface 38, is preferably pivotally disposed for adjustable movement, in an arcuate path, to a plurality of positions with respect to filaments 10. The attachment means 30, which is pivotally connected to the quench chamber 20 at point 29, substantially separates filaments 10 and cooling air 27 into respective filament and air streams 33 and 33'. More specifically, Coanda flow attachment means 30 is adjustable to a plurality of positions, such as positions A–C of FIG. 2, with respect to filaments 10, from the point at which the filaments contact Coanda surface 38, to the point, in a direction away from the filament stream, that attachment of the air stream to Coanda surface ceases.

The air stream is then diverted, in a controled manner, by attachment to, and continuous traversal of, Coanda flow attachment surface 38, so that a substantial portion of the associated cooling air 27, including entrained ambient air **27*a*, is impelled in a direction away from the filament stream 33, which is discharged in a substantially vertical direction. Thus, Coanda flow attachment means 30 provides an uninterrupted, continuous flow pathway for the air stream 33'. Coanda flow attachment means 30 is preferably curved in a downward direction, as a channel-like cross-sectional configuration, and forms an arcuate path for the separated air stream 33' to move within. Coanda flow attachment means 30, which extends from the bottom of quench chamber 20, comprises a downwardly-curved base plate 34 joined at its outer edges to a pair of downwardly-curved sidewall members 35 and 36, respectively. Preferably, sidewall members 35 and 36** are at least as wide as the thickness of the diverted air stream, and more preferably are wider than said air stream thickness.

A horizontally disposed filament-stabilizing means 37, preferably in the form of a stabilizing roll disposed for rotational movement about its horizontal central axis, is preferably contacted by, and stabilizes the flow of, the filament stream 33. Stabilizing means 37 is located between quench chamber 20 and the air jet system 60. The stabilizing means 37 is, for example, supported for rotational movement at its outer ends by a stanchion (not shown). A preferred form of stabilizing means 37 may be fabricated so that the stanchion supporting same is located within or without the confines of Coanda flow surface attachment system 30. If the stanchion is located outside sidewalls 35 and 36, openings in said sidewalls must be provided in order to accommodate said stabilizing means.

In order to facilitate control of the flow uniformity of air 27 exiting from chamber 20, an air gap adjustment means 40 is provided for adjusting the extent (S) of the quench chamber air gap exit. Means 40 is preferably in the form of a pivotal closure means 41. Closure means 41, which preferably comprises a solid closure member, is pivotally attached to quench chamber 20, about point 43, leaving an air gap (S) between air flow attachment means 40 and sidewall 21.

Coanda flow attachment means 30 is also adjustable, about hinge point 29, to a plurality of positions with respect to quench chamber 20. FIG. 2 depicts three positions, for purpose of illustration, denoted A–C, to which Coanda flow attachment means 30 can be adjustably set.

In position A, filaments 10 are further stabilized by contact with Coanda surface 38 at its maximum protrusion point 39. Cooling air 27 is diverted by continuous traversal of Coanda surface 38, and is expelled therefrom. In its preferred form, as depicted in FIG. 4, stabilizing means 37' disposed for rotational movement about its horizontal central axis, forms an integral part of attachment means 30 and is employed for minimizing frictional interaction between surface 38' and the filaments 10. Stabilizing means 37' is disposed within a slot **38*a* in surface 38 and forms an essentially continuous Coanda flow surface 38' in cooperation with said Coanda flow attachment surface 38. Stabilizing means 37', which preferably forms a maximum protrusion point 39', acts to further stabilize the filament stream as it descends downwardly toward air jet system 60. Stabilizing means 37' preferably comprises rotatable stabilizing roll 37*a*, which is maintained in position by suitable, conventional support means (not shown), and can, if desired, be mechanically driven. In the preferred embodiment depicted in FIG. 4, stabilizing means 37 is preferably employed in combination with stabilizing means 37' and is preferably located at a point closer to air jet system 60 than in the embodiment illustrated in FIG. 3, where stabilizing means 37** is employed per se.

In position B (in phantom), cooling air 27 is expelled in a similar manner to that which is described in position A. However, in this case, the filaments do not contact surface 38.

In position C (in phantom), as in the case of position B, the filaments do not contact surface 37. Furthermore, the requisite filaments and cooling air are not separated in the air diverted as in positions A and B. This is the typical position used during start-up, when an initial batch of filaments are fed to the start-up system 80. It can also be employed during the threading operation of air jet system 60.

A means 70 is provided for adjustably controling the relative position of Coanda attachment 30 with respect to quench chamber 20. Means 70 can, for example, comprise a block and tackle assembly 71 comprising block 72, pulley 73, and cord 74, which is connected to point 75 at the unhinged end of attachment means 30.

In an attempt to determine the optimum preferred relative position of attachment means 30, with respect to quench chamber 20, certain specific parameters regarding the relative location of attachment means 30 can, in general, be established. More specifically, the most significant parameters governing the preferred relative position of attachment means 30 are air gap (S), the horizontal and vertical displacement of the maximum protrusion point 39 with respect to hinged point 29, denoted H and V, respectively, and the radius of curvature with respect to surface 38 (R) measured from the center point (C) from which R is circumscribed.

EXAMPLE 1

The quench chamber system 1, as depicted in FIG. 2, is shown with attachment means 30 in three positions, denoted A–C.

In position A, when R equals 36 inches (91.4 cm) and S equals 21 inches (53.3 cm), V equals 29 inches (73.7 cm), and H equals 10.125 inches (25.7 cm), so that cooling air 27 is diverted, and substantial separation of the air 27 and filaments 10 will result.

Once cooling air 27 continuously traverses surface 38, it will continue to do so even if the extent to which V and H are reduced, as in position B, to as low as 21 inches (53.3 cm) and 6.75 inches (17.1 cm), respectively.

Further reduction of both V and H, in position C, will result in an abrupt flow detachment of cooling air 27 from surface 38.

EXAMPLE 2

In a similar quench chamber attachment means system, as described in Example 1, in position A, when R equals 27 inches (68.6 cm) and S equals 21 inches (53.3 cm), V equals 24.5 inches (62.2 cm) and H equals 15.625 inches (39.7 cm). Position B was maintained, at the above R and S values, when V equals 21.9 inches (55.6 cm) and H equals 11.22 inches (28.5 cm).

I claim:

1. A system for venting air from a plurality of filaments with which said air has become associated, comprising a Coanda flow attachment means, pivotally disposed for adjustable movement in an arcuate path to a plurality of positions with respect to said filaments, for substantially separating said filaments and said associated air into respective filament and air flow streams, said Coanda flow attachment means including a Coanda flow attachment surface for diverting said air stream, in a controlled manner, by attachment to, and continuous traversal of said Coanda flow attachment surface, said filament stream being discharged in a substantially vertical direction, and said air stream being impelled in a continuous, uninterrupted flow pathway in a direction away from said filament stream.

2. The system of claim 1, wherein said pivotally disposed Coanda flow attachment means is adjustable to a plurality of positions with respect to said filaments, from the point at which the filaments contact said Coanda surface, to the point, in a direction away from the filament stream, that attachment of the air stream to the Coanda surface ceases.

3. The system of claim 1, wherein said Coanda flow attachment means has a channel-like cross-sectional configuration.

4. The system of claim 1, wherein said Coanda flow attachment means comprises a downwardly-curved base plate member joined at its outer ends to a pair of downwardly-curved sidewall members.

5. The system of claim 4, wherein said sidewall members are at least as wide as the thickness of the diverted air flow stream.

6. The system of claim 4, wherein said sidewall members are wider than the thickness of the diverted air flow stream.

7. The system of claim 1, wherein said Coanda flow attachment means is connected to a quench chamber and, in order to further facilitate control of the uniformity of the air exiting from said quench chamber, an air gap adjustment means is provided for adjusting the extent of the quench chamber air exit gap.

8. The system of claim 1, which further includes a horizontally disposed filament-stabilizing means which is contacted by, and stabilizes the flow of, the separated filament stream.

9. The system of claim 1, wherein said filament-stabilizing means comprises a stabilizing roll disposed for rotational movement about its horizontal central axis.

10. The system of claim 9, wherein said filament-stabilizing means is disposed within a slot in the Coanda flow attachment surface, and forms an essentially continuous Coanda flow surface in cooperation with said Coanda flow attachment surface.

11. The system of claim 10, wherein said filament-stabilizing means forms the maximum protrusion point of said Coanda flow attachment surface.

12. A method for venting air from a plurality of filaments with which said air has become associated, comprising separating said filaments and a substantial amount of said associated air into respective filament and air flow streams, and diverting the air stream from the filament stream, in a controlled manner, by attachment to, and continuous traversal of a Coanda flow attachment surface, the position of the Coanda flow attachment surface being adjustable with respect to the filament stream from the point at which the filament stream contacts the Coanda flow attachment surface to the point, in a direction away from said filament stream, that flow attachment of the air stream to the Coanda surface terminates, the filament stream being discharged in a substantially vertical direction and the air stream being impelled in a direction away from said filament stream, and the Coanda flow attachment surface providing an uninterrupted, continuous flow pathway for diverting a substantial amount of said associated air.

13. The method of claim 12 which further includes the step of stabilizing said filaments employing a horizontally disposed filament-stabilizing roll disposed for rotational movement about its horizontal central axis.

14. The method of claim 13, wherein said stabilizing step is conducted employing said horizontally-disposed filament-stabilizing means, which is disposed within a slot in the Coanda flow attachment surface to form a continuous Coanda surface in conjunction with said Coanda flow attachment surface.

* * * * *